US005257082A

United States Patent [19]

Kobayashi et al.

[11] Patent Number: 5,257,082

[45] Date of Patent: Oct. 26, 1993

[54] COPIER WITH AUTOMATIC INSERT FEED HAVING AN INTERRUPT FUNCTION

[75] Inventors: Chiharu Kobayashi, Tachikawa; Masaru Ushio, Hachioji; Tomoya Motoyoshi, Sagamihara, all of Japan

[73] Assignee: Konica Corporation, Tokyo, Japan

[21] Appl. No.: 586,283

[22] Filed: Sep. 21, 1990

[30] Foreign Application Priority Data

Sep. 25, 1989 [JP] Japan ..... 1-246385

[51] Int. Cl.[5] ..... G03G 21/00

[52] U.S. Cl. ..... 355/325; 271/9; 355/206

[58] Field of Search ..... 355/309, 311, 321, 323, 355/325, 246, 204, 208; 270/95; 414/789.5, 789.6; 271/9

[56] References Cited

U.S. PATENT DOCUMENTS 4,190,246 2/1980 Sasuga ..... 355/311 X
4,763,889 8/1988 Dei et al. ..... 271/9
4,796,056 1/1989 Ito ..... 355/206
4,924,265 5/1990 Partilla et al. ..... 355/325 X
4,961,092 10/1990 Rabb et al. ..... 355/323
5,006,904 4/1991 Matsuo et al. ..... 355/311 X

*Primary Examiner*—Leo P. Picard
*Assistant Examiner*—Christopher Horgan
*Attorney, Agent, or Firm*—Finnegan, Henderson, Farabow, Garrett & Dunner

[57] ABSTRACT

An electrophotographic copying machine capable of inserting an inter-sheet in a copy of a document. A width-detector is provided to detect the width of an inter-sheet contained in an inter-sheet tray. A judging circuit determines if the detected width of the inter-sheet is within an allowable width range. If the detected width is not within the allowable width range, the inter-sheet is inhibited from being fed and reminder information is displayed. If the inter-sheet is required to be blank with no image of the original recorded thereon, an automatic document feeder is controlled so as to stop feeding the original sheet while the inter-sheet is conveyed to be placed at the insert-page. The adjustment of copy image density, including scanning of the original sheet, is also stopped.

3 Claims, 10 Drawing Sheets

COPIER WITH AUTOMATIC INSERT FEED HAVING AN INTERRUPT FUNCTION

BACKGROUND OF THE INVENTION

The present invention relates to improvements in a copier having a copying mode (an intersheet mode) in which an inter-sheet distinguishing passages in a document is inserted between recording sheets corresponding to the document sheets, wherein the inter-sheet is a colored paper and the like.

The intersheet mode is defined as: when a plurality of document sheets are copied, a colored paper distinguishing passages in a document is inserted between recording sheets corresponding to the document; and further when a cover is attached before the first page, the colored paper is provided.

There are two kinds of intersheet mode relating to the prior art. One is a mode in which copying is not conducted on an inter-sheet (this mode will be called Intersheet Mode I hereafter), and the other is a mode in which the summary of the following chapter and the like are copied on the inter-sheet (this mode is called Intersheet Mode II). The difference between Intersheet Mode I and Intersheet Mode II is that there exists no document corresponding to an inter-sheet in the former. In other words, while the inter-sheet is being fed, copying operation is conducted in the state of no document in Intersheet Mode I. To explain it more concretely, as the advantage of Intersheet Mode is the automatic copy function, especially in Intersheet Mode I, it is preferable to provide an automatic document feed means and it can be said that the automatic document feed means is necessary, and in the case of a copier to which the automatic document feed means is provided, the automatic document feed means must be temporarily stopped when the inter-sheet of Intersheet Mode I is fed. If the automatic document feed means is not stopped, the next document sheet is copied on the inter-sheet of a colored paper.

The following are the summarized explanations of the function of each Intersheet Mode in the prior art.

(1) Intersheet Mode I

Refer to FIG. 5*a*.

At the outset of Intersheet Mode I, the inter-sheet insertion page indicating process is carried out, in which an operater inputs the page data of the document before or after which the inter-sheet is inserted (a).

After that, an ordinary copying process is started. Even if the copier is provided with an automatic document feeder or not, documents are fed in order of page and a predetermined number of copies are made with regard to each page of the document.

When an inter-sheet insertion page judging means has detected that the page of the document has reached the inter-sheet insertion point (d), a recording paper feeding tray is changed from an ordinary tray to an inter-sheet feed tray which is loaded with inter-sheet (colored papers, for example) ($e_1$). In the case of a copier to which an automatic document feeder is provided, the operation of the copier is stopped while an inter-sheet (a colored paper, for example) is being fed.($f_1$).

In the case of a copier having an automatic document feed means in which a recording paper feeding tray is changed to an inter-sheet supply tray, its operation is stopped, and then copying operation is conducted in the state that a document is not supplied ($g_2$).

After the copy operation has been completed, the paper tray is changed from the inter-sheet supply tray to the recording paper feeding tray ($e_2$). In the case of a copier provided with an automatic document means, the automatic document feed means is started again ($f_2$).

On the other hand, when the inter-sheet insertion page judging means has judged that the page is not the insertion point (d), the copying operation is continuously conducted while the paper tray is not changed ($g_1$).

The above-described operations are repeatedly conducted until all the document pages have been copied (h).

(2) Intersheet Mode II

Refer to FIG. 5*b*.

At the outset of Intersheet Mode II the inter-sheet insertion page indicating process is carried out, in which the inter-sheet insertion page is set (a).

Then, the ordinary copying process is started. Even if it is a copier provided with an automatic document feeder or not, documents are fed in the order of page and a predetermined number of copies are made.

When the inter-sheet insertion page judging means has judged that the document page has reached the insertion point (d), the paper feeding tray is changed to the inter-sheet supply tray ($e_1$).

Then, copying operation is conducted ($g_2$). At this time, an inter-sheet (a colored paper, for example) is fed and a document which is to be copied onto the inter-sheet, is simultaneously fed. When the copying operation has been completed, the paper feeding tray is changed from the inter-sheet supply tray to the recording paper feeding tray ($e_2$).

On the other hand, when the inter-sheet insertion judging means has judged that the document has not reached the insertion point (d), the copying operation is conducted while the paper feeding tray is not changed ($g_1$).

The above-described operations are repeatedly conducted until all the document pages have been copied (h).

The first problem of the prior art is that: in the copier of the prior art, the inter-sheet size is limited to $A_3$, $B_4$, $A_4$, and $B_5$, so that other sizes are not available.

However, in the case of the inter-sheet of specific size such as $A_3R$, $A_2$, a universal size, and in the case the separating paper is fed by the sheet by-pass cassette, the copying processes such as paper feed and disposal of jammed paper do not function normally. Accordingly, Intersheet Mode I or Intersheet Mode II can not be carried out when the inter-sheet is one of those specific cassette sizes, $A_3R$, $A_2$, a universal, and a sheet by-pass, the inter-sheet conveyance and copying operation can not be conducted.

As explained above, in the case of the copier of the prior art, when the specific size inter-sheet, the size of which is one of $A_3R$, $A_2$, a universal, and a sheet by-pass, is set, the inter-sheet can not be conveyed and the copying operation can not be carried out, so that an operator misunderstands that the copier is out of order and stops the copying operation to investigate the cause of breakdown. This stop time is not necessarily short and the efficiency of copying operation is decreased. The conventional copier in which Intersheet Mode I or Intersheet Mode II can be used, has such a fault as described above.

The first object of the present invention is to correct the fault of the conventional copier so that the operator can not misunderstand that the copier is out of order when he sets a wrong size inter-sheet to the copier, and accordingly unnecessary operation stop can be prevented, and further the waste of time to investigate the cause of a false breakdown can be eliminated.

The second problem of the prior art can be explained as follows.

There is a copier to which the automatic density selecting function (EE) is provided in order to automatically adjust the image density of a print. In the case of a copier of the prior art, the automatic density selecting function (EE) can work when the copier is in the above-described Intersheet Mode I.

This automatic density selecting (EE) function is the function which can work in such a manner that: the letter region on a document is scanned by an image sensor over a whole page so that the average density of the letter region can be detected; and in response to the average density, the printing density is controlled, wherein the operation time of the automatic density selecting (EE) function is about 100 ms per a page of document.

This Intersheet Mode I is useful to a copier to which the automatic document feeder is not provided. However, it is especially useful to a copier to which the automatic document feeder is provided, so that the following explanations will be given under the condition that the copier is provided with an automatic document feeder.

As described above, the automatic density selecting (EE) function (which will be called EE hereafter) works in Intersheet Mode I in the case of the copier provided with an automatic document feeder. This EE function is not essentially needed in the case of Intersheet Mode I. As described above, the operation time of this EE function is approximately 100 ms per one document. Consequently, the waste of time occurs which amounts to the product of the operation time of EE ,.function per one document sheet (which is generally about 100 ms) and the number of time of the inter-sheet insertion. This waste time can not be overlooked as the copying speed of a copier has been further increased recently.

The second object of the present invention is to correct the fault of a conventional copier described above and to provide a copier in which the waste of time does not occur.

SUMMARY OF THE INVENTION

The first object of the present invention can be accomplished by either of the following means.

The first means can be described as follows.

A copier having Intersheet Mode I and which is provided with: an inter-sheet insertion indicating means to designate a page to which the inter-sheet is inserted; an automatic document feed means which feeds documents to be copied in order; an inter-sheet insertion page judging means which judges a page to which an inter-sheet is inserted; an automatic document feed stop/re-start means and paper tray exchanging means which responds to the above-described inter-sheet insertion page judging means, stops the above-described automatic document feed means, changes the paper feeding tray to the inter-sheet supply tray, and re-starts the above-described automatic document feed means in order to change the paper tray to a recording paper feeding tray after the above-described inter-sheet has been fed; and a copy means. Further the copier comprises: an inter-sheet tray width detecting means which detects the paper width of the paper tray; an inhibited width judging means which judges whether the width of the inter-sheet tray is inhibited or not according to the detected results by the above-described inter-sheet supply tray width detecting means; and a width inhibition display means which displays that the paper width is inhibited after the above-described inhibited width judging means has judged that the width of the inter-sheet supply tray is inhibited.

The second means can be described as follows.

A copier having Intersheet Mode II and which is provided with: an inter-sheet insertion indicating means which indicates a page to which the inter-sheet is inserted; an inter-sheet insertion page judging means which judges a page to which an inter-sheet is inserted; a paper feeding tray changing means which responds to the motion of the above-described inter-sheet insertion page judging means, changes the paper feeding tray into a inter-sheet tray , and changes into a recording paper tray after the above-described inter-sheet supply has been completed; and a copy means. Further the copier comprises: an inter-sheet tray width detecting means which detects the paper width of the paper tray; an inhibited width judging means which judges whether the width of the inter-sheet tray is inhibited or not according to the detected results by the above-described inter-sheet supply tray width detecting means; and a width inhibition display means which displays that the paper width is inhibited after the above-described inhibited width judging means has judged that the width of the inter-sheet supply tray is inhibited.

In the above-described copier, the following message is displayed on a control panel. When an operator does not notice that the width of an inter-sheet supply tray is an inhibited paper width and he sets the inter-sheet of $A_3R$ or $A_2$ in order to carry out Inter-sheet Mode I or Inter-sheet Mode II, a message that the paper width is the inhibited one and that the inter-sheet should be changed to a right one, is displayed on the control panel.

The above-described second object can be accomplished by a copier having an automatic document feeder and the copier is provided with: an inter-sheet insertion indicating means which indicates a page to which the inter-sheet is inserted; an inter-sheet insertion page judging means which judges a page to which an inter-sheet is inserted; a paper feeding tray changing means which changes the paper feeding tray into a inter-sheet tray, and changes into a recording paper tray after the above-described inter-sheet supply has been completed; and a copy means, and further the copier comprises a density selecting (EE) function stop and re-start means which responds to the completion of the above-described inter-sheet supply and re-starts an automatic density selecting function.

In the copier of the present invention, the working operation is conducted as follows. In Intersheet Mode, at the same time when the paper feeding tray is changed, the automatic density selecting (EE) means is temporarily stopped, then a predetermined number of inter-sheet is fed and after that EE means is started. About 100 ms per one inter-sheet can be economized by stopping this EE means. While EE means is stopped, the copy density becomes the standard value.

DETAILED DESCRIPTION OF THE INVENTION

Figure 1A:
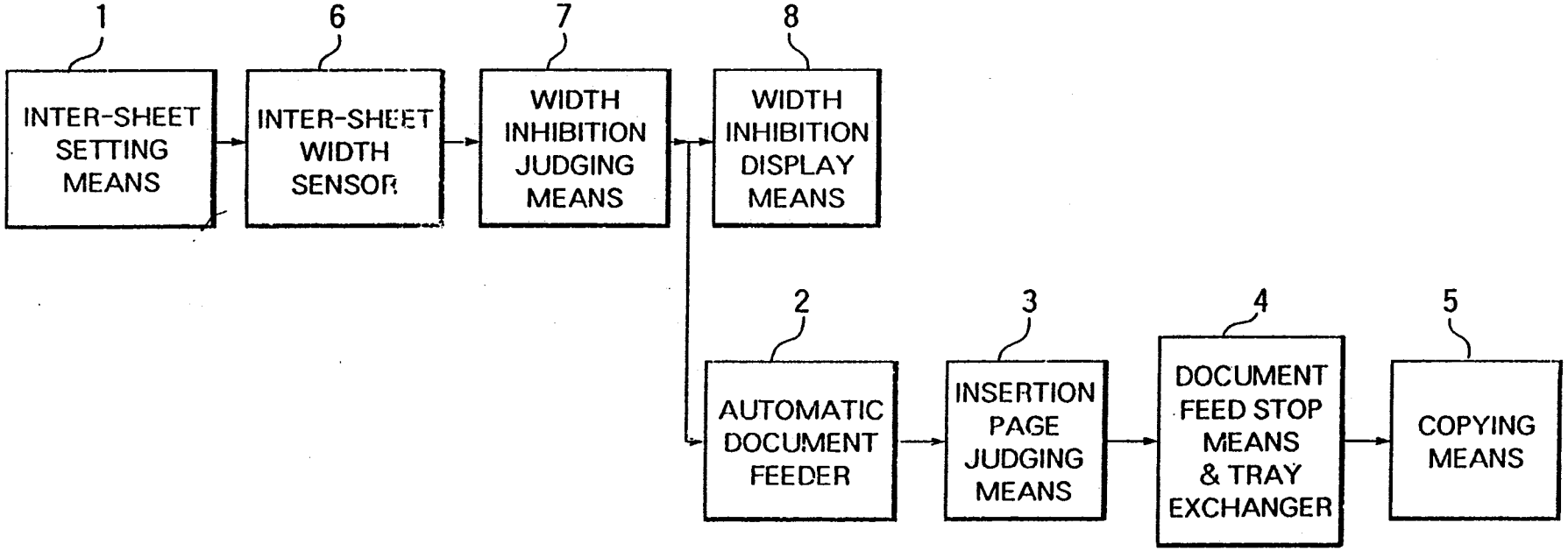
FIG. 1*a* is a drawing which shows the relation between the functional components of the first example of the copier of the present invention.

Referring now to the drawings, 3 examples of the copier of the present invention will be described as follows.

Figure 3:
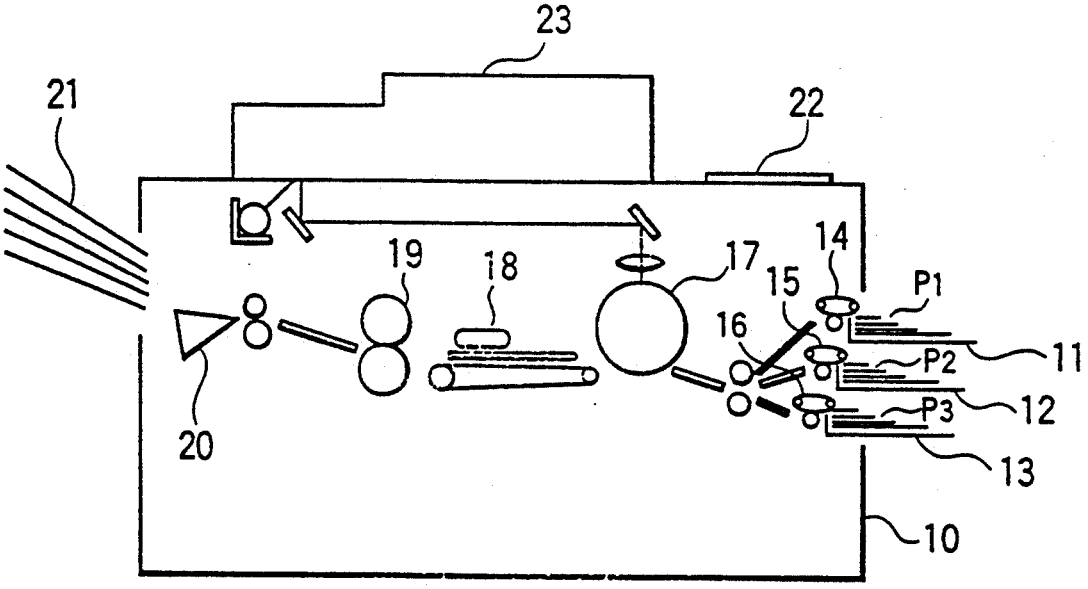
FIG. 3 is a schematic illustration of the example of the copier of the present invention.

FIG. 3 is a schematic illustration of a conventional copier which is so called Carlson type copier.

FIG. 3 is common to 3 examples.

In FIG. 3, the numeral 10 is a copier main body. The numerals 11, 12, and 13 are paper feeding trays to which cassettes $P_1$, $P_2$, and $P_3$ are provided. The numerals 14, 15, and 16 are paper feed rollers which feed recording papers $P_1$, $P_2$, and $P_3$. The numeral 17 is a recording drum which is the most important member in a copier, wherein not only inorganic photosensitive materials such as selenium but also organic photosensitive materials are used for the recording drum. The numeral 18 is a fixing unit in which a high molecular compound composing toner is fused and solidified so that the toner can be fixed on the surface of a recording paper. The numeral 19 is a delivery roller which delivers a recording paper. In this example, a sorter is provided, and the numeral 20 is a guide of the sorter by which recording papers are delivered to different sorter bins 21. The numeral 22 is a control panel on which various operation keys and display means are provided. The numeral 23 is an automatic document feeder which is installed at user's option.

Figure 4:
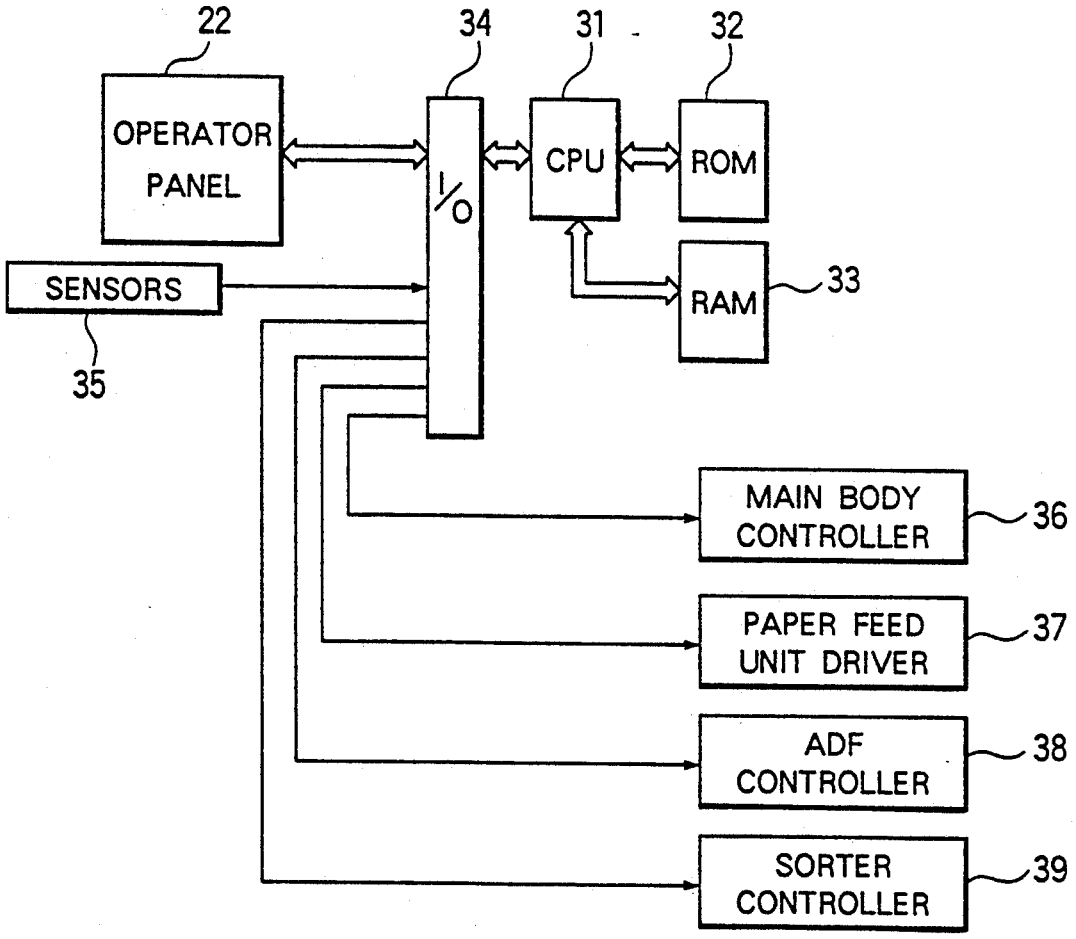
FIG. 4 is a schematic illustration of the control means of the example of the copier of the present invention.
Figure 5A:
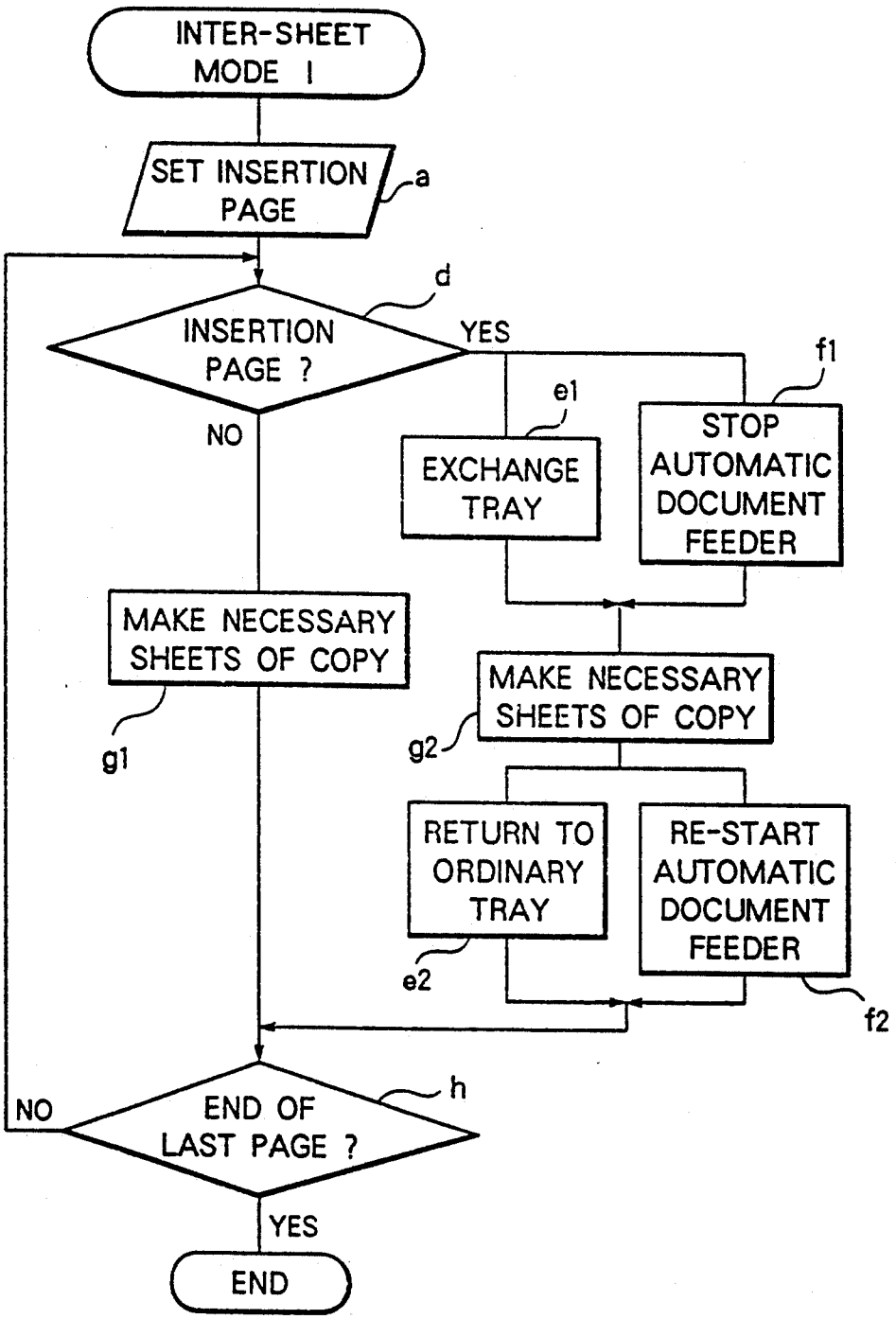
FIG. 5*a* is a flow chart which shows Intersheet Mode I of a conventional copier.
Figure 5B:
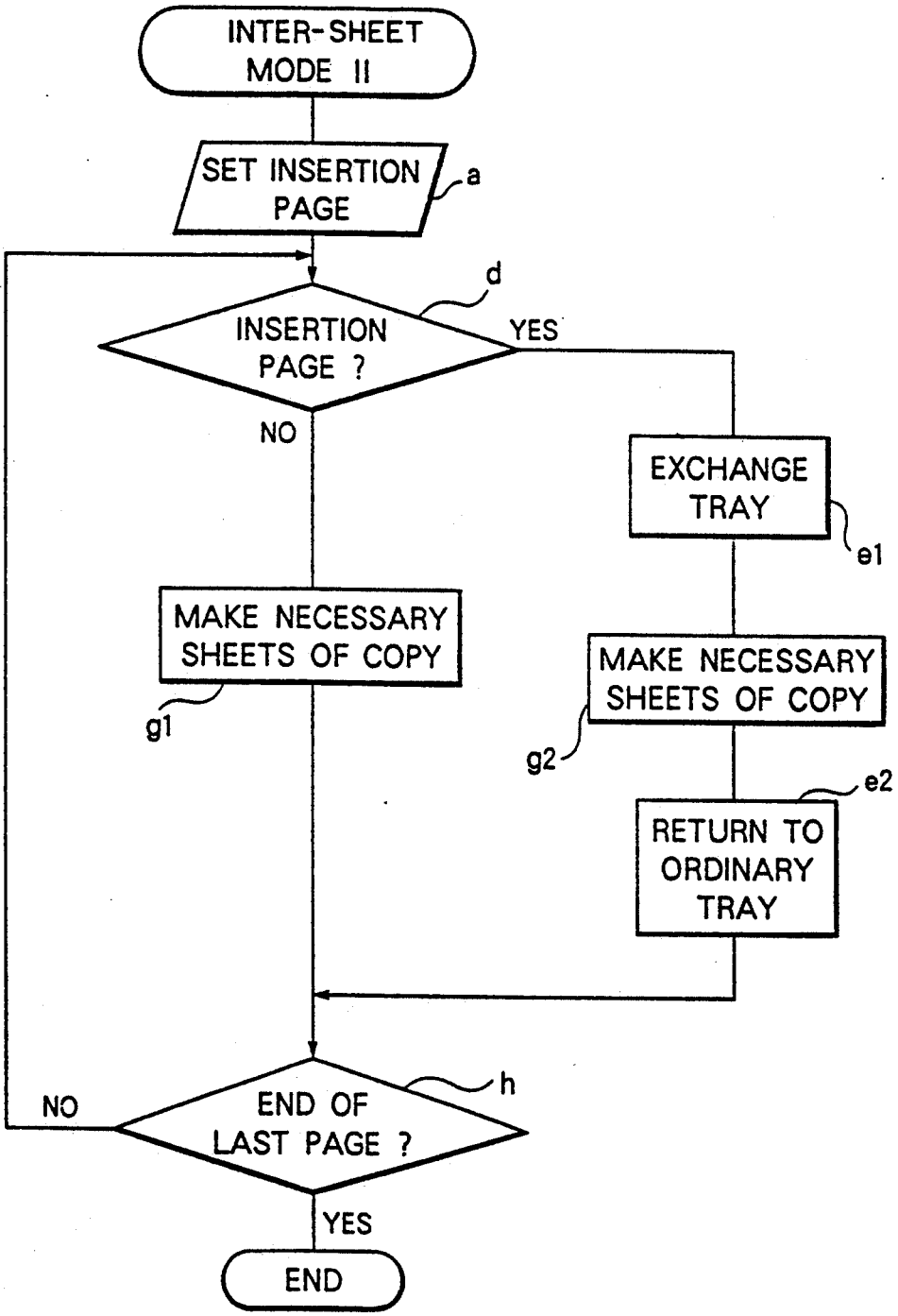
FIG. 5*b* is a flow chart of Intersheet Mode II of a conventional copier.

In FIG. 4, the outline of the control means of the above-described copier is shown.

FIG. 4 is common to each example.

In FIG. 4, the control means of a copier is provided with the microcomputer 30 comprising the CPU 31, the ROM 32, the RAM 33, and the input and output interface I/O 34. The above-described CPU 31 conducts arithmetic processing according to the program stored in the ROM 32, wherein the directions given by the operation panel 22 and various information obtained by various sensors 35 are used in the arithmetic processing, and the CPU 31 controls the following mechanical control means through the input and output interface I/O 34. The main body control unit 36 to control the optical system, the paper feed unit driver 37 to control the paper feeding roller 14, 15, 16, the ADF control unit 38 to control the automatic document feeder (ADF) 23 , and the sorter control unit 39 to control the sorter are included in the mechanical control means of this example.

Referring now to the drawings, the inhibited paper width judging means and the inhibited paper width displaying means which are concerned with the essential point of the present invention, will be explained as follows.

EXAMPLE 1

A copier equipped with Intersheet Mode I

In FIG. 1*a*, the numeral 1 is an inter-sheet insertion indicating means to which an operator inputs the data of the inter-sheet insertion through the operation panel, wherein the data indicates the page number to which the inter-sheet is inserted. The ten keys on the operation panel are usually used as the indicating means.

The numerals 6, 7, and 8 are means which are concerned with the essential point of the present invention.

The numeral 6 is an inter-sheet feeding tray width detecting means which detects the width of the inter-sheet held in an inter-sheet feeding tray.

The numeral 7 is an inhibited paper width judging means which judges whether the inter-sheet width is an inhibited paper width or not, wherein the judging is conducted according to the results of detection by the above-described inter-sheet feeding tray width detecting means 6.

The numeral 8 is an inhibited paper width displaying means which displays that the the width of the inter-sheet is inhibited according to the judgment of the inhibited paper width judging means 7.

The following means have been used in the copier which is concerned with the prior art.

The numeral 2 is an automatic document feeder which feeds each page of a document in order. The numeral 3 is an inter-sheet insertion judging means which judges whether an inter-sheet should be inserted to the recording paper corresponding to the document page or not. The numeral 4 is an automatic document feeder stop/re-start means and paper feeding tray changing means which stops the motion of the automatic document feeder 2 in accordance with the output of the inter-sheet insertion page judging means 3, which changes the paper feeding tray into the inter-sheet feeding tray, which re-starts the automatic document feeder 2 after the above-described inter-sheet has been fed, and which changes the paper feeding tray to the recording paper tray. The numeral 5 is a copy means which conducts copying operation.

Figure 2A:
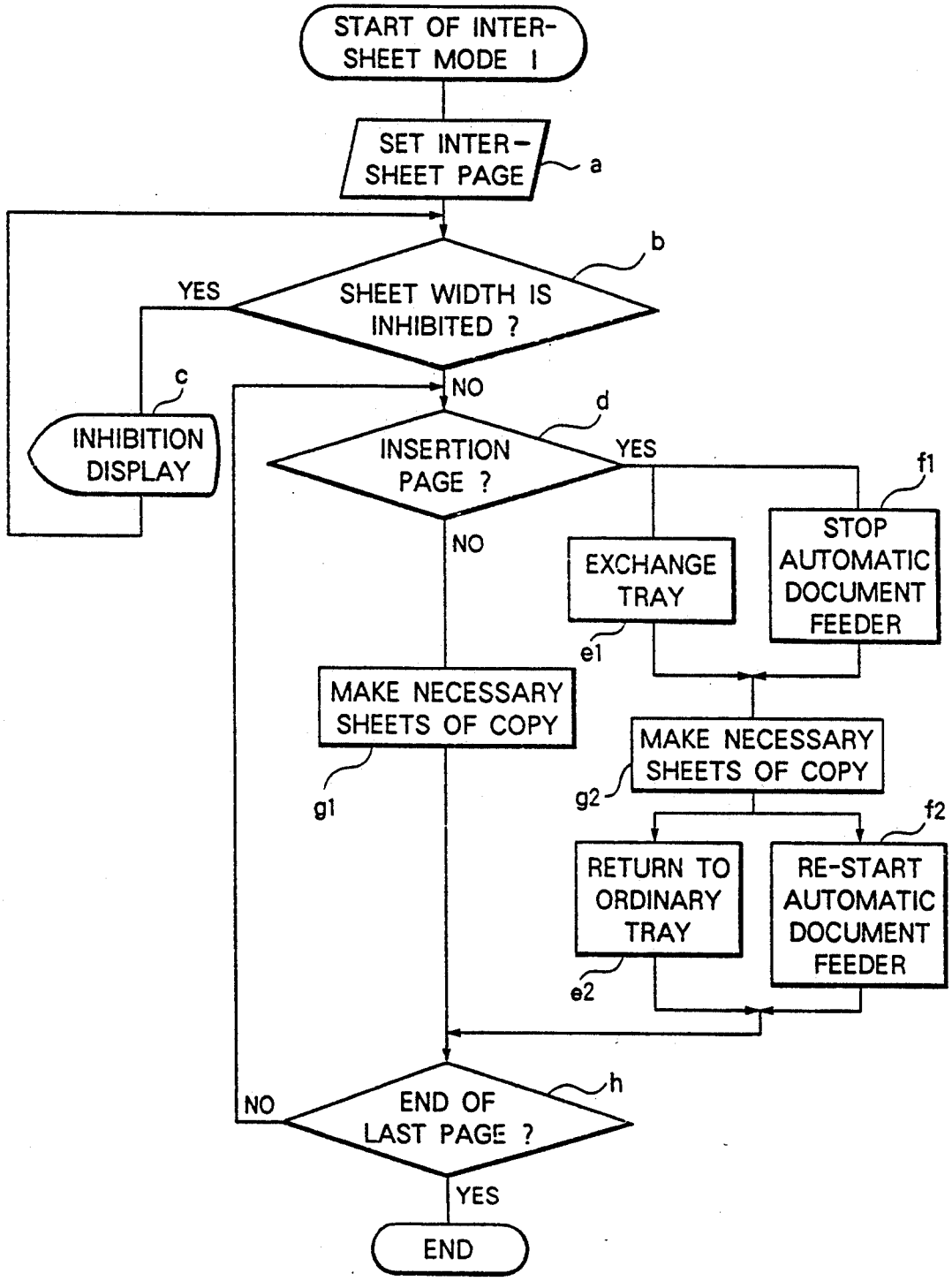
FIG. 2*a* is a flow chart of the first example of the copier of the present invention.

Referring to a flow chart in FIG. 2*a*, the above-described functions will be explained as follows.

At the first process, the page to which the inter-sheet is inserted, is set using the inter-sheet insertion indicating means composed of ten keys (not illustrated in the drawing) provided to the operation panel 22 (*a*).

Then, the width of the inter-sheet held in the inter-sheet tray is detected by the inter-sheet tray width detecting means 6, and the inhibited inter-sheet width judging means 7 judges whether the detected inter-sheet width is an inhibited inter-sheet width or not (b).

When the inhibited width judging means 7 detected that the width was inhibited (b), the inhibited width display means 8 is activated in accordance with the response of the inhibited width judging means 7 and displays the following message on a liquid crystal display unit provided to the operation panel: the width of the inter-sheet held in the inter-sheet feeding tray is inhibited, so that exchange the inter-sheet for another one of the allowable width (c). The copying operation is stopped here, and the copying program is not advanced unless an operator carries out the following procedures: complying with the message, the operator exchanges the inter-sheet feeding tray, and then the inhibited width judging means 7 is started again.

When the above-described inhibited width judging means 7 judges that the width of the inter-sheet is not inhibited (b), the process is advanced to the next one and the inter-sheet insertion page judging means 3 is activated. The above means 3 judges whether the copied page has reached the designated page or not, wherein the term of the designated page means the page which was previously designated as the page to which the inter-sheet is inserted. When the page has reached the designated page, the direction is outputted so that an inter-sheet can be inserted (d).

Firstly, when the inter-sheet insertion page judging means 3 has judged that the page is not an inter-sheet insertion page (d), the copying process is conducted in accordance with the direction of the inter-sheet insertion page judging means 3 and a predetermined number of copies are made. ($g_1$).

Secondly, when the inter-sheet insertion page judging means 3 has judged that the insertion page has come up (d), the above-described automatic document feeder 2 is stopped ($f_1$) in accordance with the direction sent from the inter-sheet insertion page judging means 3, and the paper feeding tray is replaced with the inter-sheet feeding tray ($e_1$).

A predetermined number of copies are made ($g_2$) and after the above-described inter-sheet has been delivered, the above-described automatic document feeder 2 is started again ($f_2$) and the inter-sheet feeding tray is replaced with the recording paper tray ($e_2$).

The above-described processes are repeated until the last page is copied. When the copying process has reached the last page (h), the copying operation is completed.

EXAMPLE 2

A copier provided with Intersheet Mode II

Figure 1B:
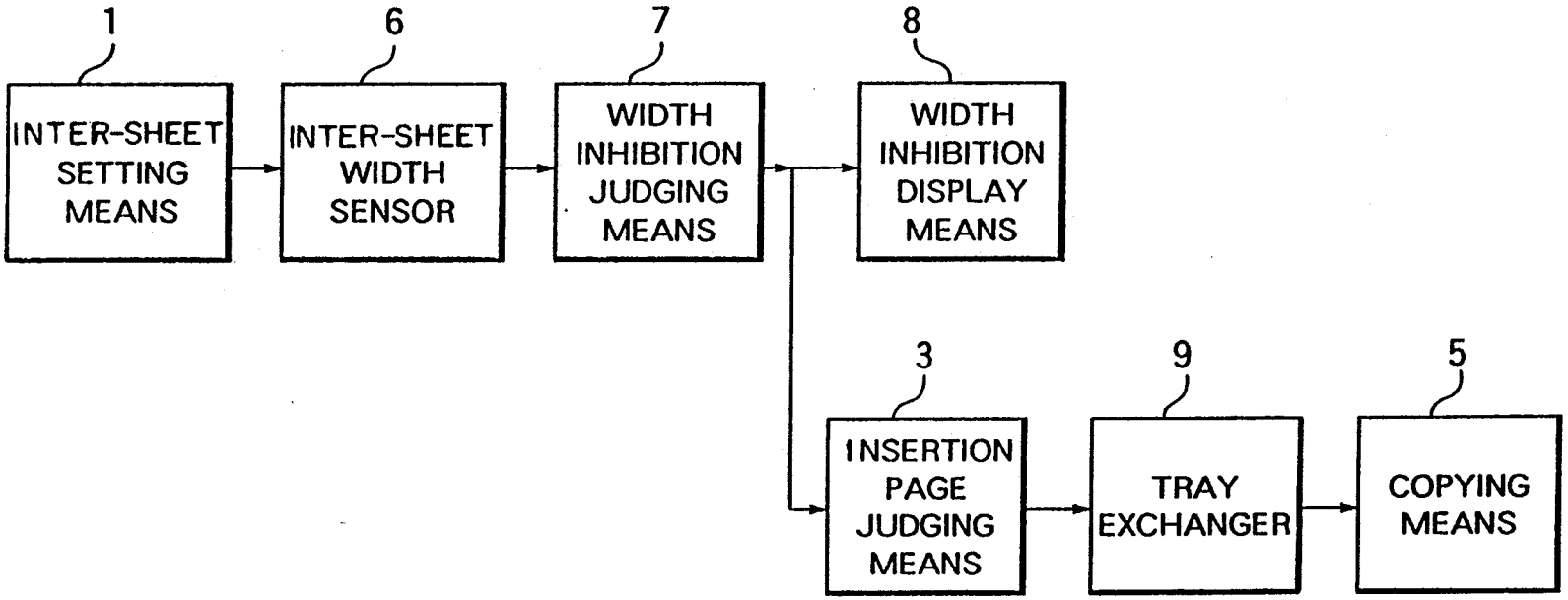
FIG. 1*b* is a drawing which shows the relation between the functional components of the second example of the copier of the present invention.

In FIG. 1*b*, the numeral 1 is an inter-sheet insertion page indicating means to which an operator inputs the page number of inter-sheet insertion with an operation panel. Ten keys on the operation panel are usually used as the inputting means.

The numerals 6, 7, and 8 are means which are concerned with the essential point of the present invention.

The numeral 6 is an inter-sheet feeding tray width detecting means which detects the width of the inter-sheet held in an inter-sheet tray.

The numeral 7 is an inhibited paper width judging means which judges whether the inter-sheet width is an inhibited paper width or not, wherein the judging is conducted according to the results of detection by the above-described inter-sheet feeding tray width detecting means 6.

The numeral 8 is an inhibited paper width displaying means which displays that the the width of the inter-sheet is inhibited according to the judgment of the inhibited paper width judging means 7.

The following means have been used in the copier which is concerned with the prior art.

The numeral 3 is an inter-sheet insertion judging means which judges whether an inter-sheet should be inserted to the recording paper corresponding to the document page or not. The numeral 9 is a paper feeding tray changing means which stops the motion of the automatic document feeder 2 in accordance with the motion of the inter-sheet insertion page judging means 3, which changes the paper feeding tray into the inter-sheet feeding tray, which re-starts the automatic document feeder 2 after the above-described inter-sheet has been fed, and which changes the paper feeding tray into the recording paper tray. The numeral 5 is a copy means which conducts copying operation. The automatic document feeder 2 which was described in the example of Inter-sheet Mode I may be applied to the example of Intersheet Mode II. As described above, the effect of Intersheet Mode is to improve the efficiency of copying operation, and the installation of the above-described automatic document feeder can contribute to the improvements in copying operation.

Figure 2B:
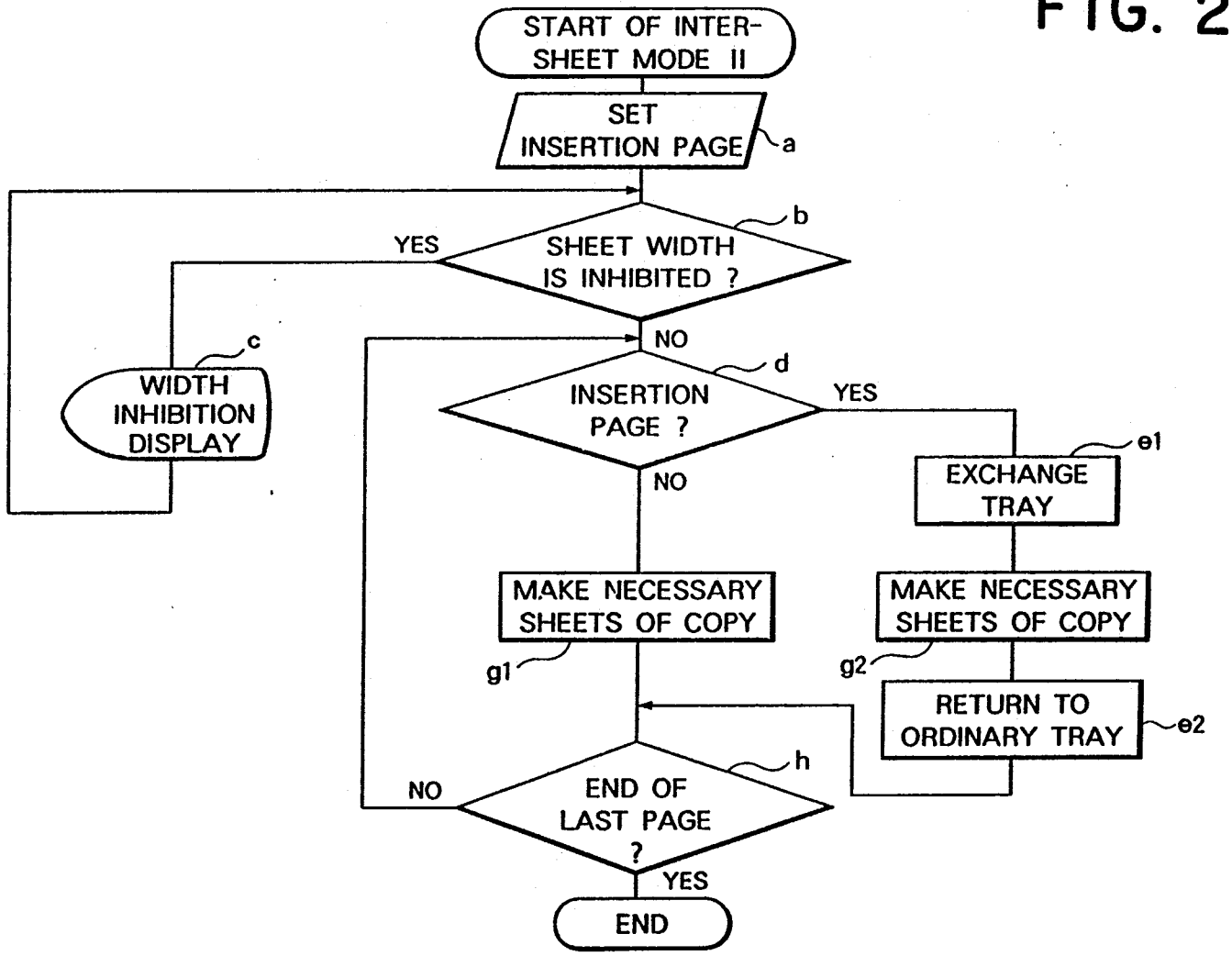
FIG. 2*b* is a flow chart of the second example of the copier of the present invention.

Referring to FIG. 2*b*, the function of the example of Intersheet Mode II will be explained as follows.

At the first process, the operater inputs the page data to which the inter-sheet is to be inserted using the inter-sheet insertion indicating means composed of ten keys (not illustrated in the drawing) provided to the operation panel 22 (a).

Then, the width of the inter-sheet held in the inter-sheet tray is detected by the inter-sheet tray width detecting means 6, and the inhibited inter-sheet width judging means 7 judges whether the detected inter-sheet width is an inhibited inter-sheet width or not (b).

When the inhibited width judging means 7 judges that the width was inhibited (b), the inhibited width display means 8 is activated and displays the following message on a liquid crystal display unit provided to the operation panel: the width of the inter-sheet held in the inter-sheet feeding tray is inhibited and exchange the inter-sheet for another one of the right width (c) is necessary. The copying operation is stopped here, and the copying program is not advanced unless an operator carries out the following procedures: complying with the message, the operator exchanges the inter-sheet feeding tray, and then the inhibited width judging means 7 is started again.

When the above-described inhibited width judging means 7 judges that the width of the inter-sheet is not inhibited (b), the process is advanced to the next one and the inter-sheet insertion page judging means 3 is activated, and judges whether the copied page has reached the designated page or not, wherein the term of the designated page means the page which was previously designated as the page to which the inter-sheet is inserted. When the page has reached the designated page, the direction is outputted so that an inter-sheet can be inserted (d).

Firstly, when the inter-sheet insertion page judging means 3 has judged that the page is not an inter-sheet insertion page (d), the copying process is conducted accordance with the direction of the inter-sheet insertion page judging means 3 and a predetermined number of copies are made ($g_1$).

Secondly, when the inter-sheet insertion page judging means 3 has judged that the insertion page has come up (d), in accordance with the direction sent from the inter-sheet insertion page judging means 3 the paper feeding tray is replaced with the inter-sheet feeding tray ($e_1$). In this example, copying operation is conducted on the inter-sheet, so that a document corresponding to the inter-sheet necessarily exists, and while the inter-sheet is being fed, the document (which can be a blank paper) must be fed.

Under the conditions described above, a predetermined number of copies are made ($g_2$), and after the above-described inter-sheet has been delivered, the inter-sheet tray is replaced with the recording paper tray ($e_2$).

The above-described process is repeated until the process reaches the last page (h) so that the copying operation is completed.

Figure 6:
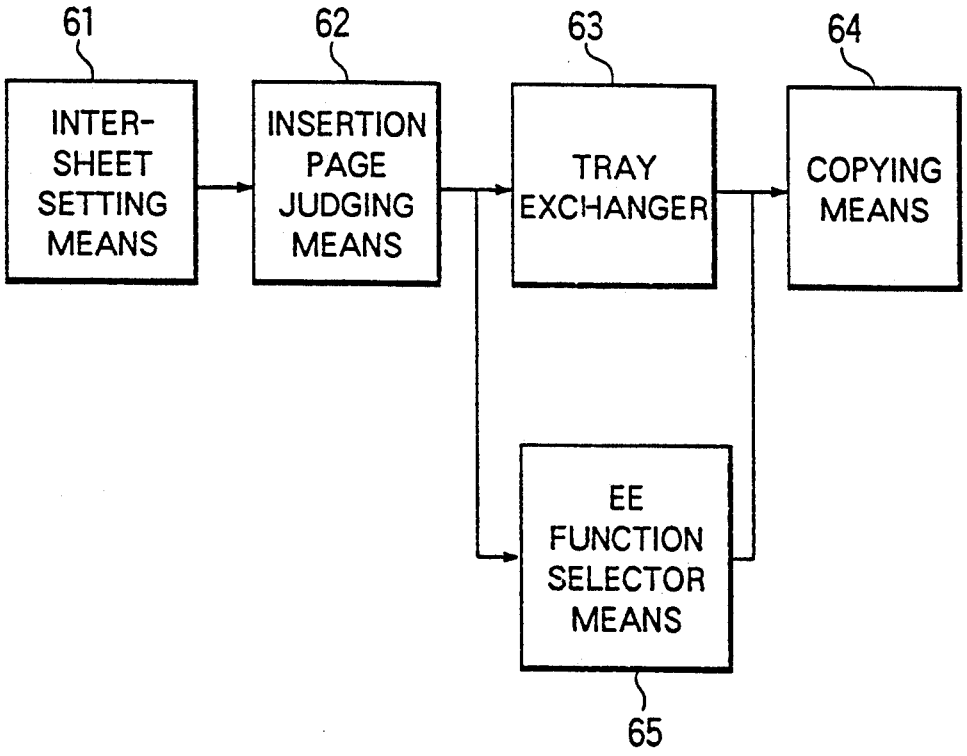
FIG. 6 is a drawing which shows the fundamental composition of the third example of the copier of the present invention.

Referring now to the drawings, an example to accomplish the second object of the present invention will be explained as follows. FIG. 6 shows the fundamental composition of EE function stopping means and re-starting means.

In the drawing, the numeral 61 is an inter-sheet insertion indicating means to which the data of inter-sheet insertion is inputted by an operator, wherein the operator inputs the data on an operation panel before the start of copying operation. In this case, ten keys on the operation panel are used to input the data. In the case of a copier in common use, the copier has the function that the number of copies is designated in advance. When the operator presses a start key in order to direct the start of operation, the documents to be copied are successively copied so that a predetermined number of copies can be made. The numeral 62 is an inter-sheet insertion page judging means which judges whether the copied page has reached the page to which an inter-sheet must be inserted or not. The numeral 63 is a paper feeding tray changing means which changes the paper feeding tray from the ordinary recording paper tray to the inter-sheet tray according to the results of the judging of the above-described inter-sheet insertion page judging means. This paper feeding tray changing means 63 has the function of changing the inter-sheet feeding tray to the ordinary recording paper feeding tray. The numeral 65 is an automatic density selecting (EE) function stop and re-start means which is an essential point of the present invention. EE function of the above-described EE function stop and re-start means 65 is stopped until a predetermined number of inter-sheets have been copied. After the predetermined number of inter-sheets have been copied and the paper feeding tray has been changed to the ordinary recording paper feeding tray by the above-described paper feeding tray changing means 63, the above-described EE function is started again. In the case of a copier which is not provided with an automatic document feeder (ADF) 23, the document sheet to be copied should not be fed while the ED function is stopped.

Figure 7:
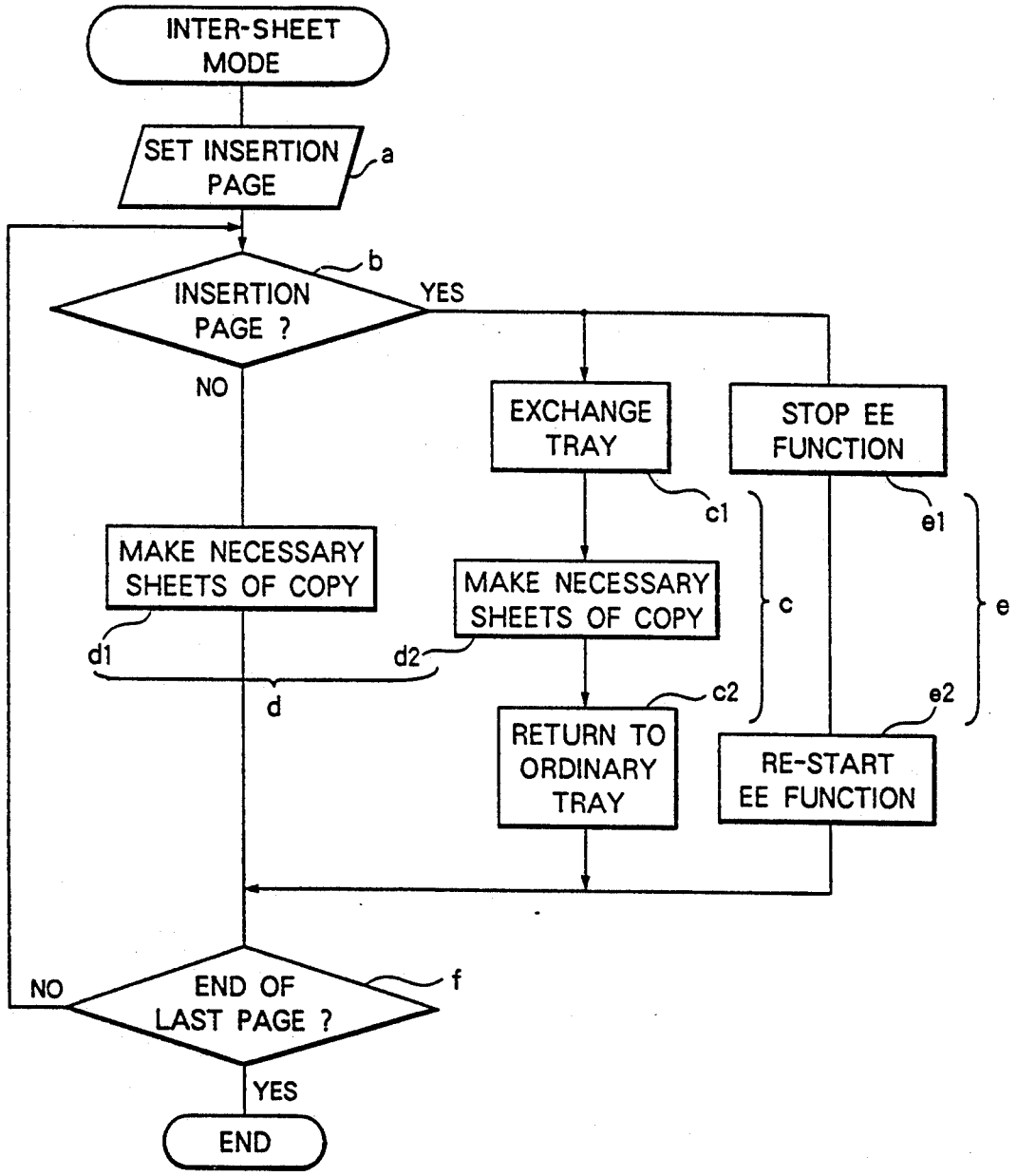
FIG. 7 is a flow chart of Intersheet Mode of the third example of the copier of the present invention.

Referring now to a flow chart illustrated in FIG. 7, the above-described function will be described as follows.

As explained above, the copier of the present invention is provided with the density selecting (EE) function stop and re-start means 65, which stops the automatic density selecting (EE) function in response to the action of the inter-sheet insertion page judging means 62, and which re-starts the density selecting (EE) function in response to the completion of inter-sheet feeding.

At the outset of the process, the page to which the inter-sheet is inserted, is indicated by an operator through the inter-sheet insertion indicating means 61 which is composed of ten keys provided to the operation panel 22 (*a*).

When the copier is started, a predetermined number of copies are made with regard to each document. At this moment, the inter-sheet insertion page judging means 62 is started. The inter-sheet insertion page judging means 62 judges whether the copied page is the one to which an inter-sheet should be inserted or not, wherein the copied page numbers are counted in the means and used to judge the insertion page. When the recorded page has reached the inter-sheet insertion page, a direction is outputted by the means (b).

Firstly, when the inter-sheet insertion page judging means 62 has judged that the page is not the one to which an inter-sheet is not inserted, the copying process is carried out in response to the direction outputted from the means ($d_1$).

Secondly, When the inter-sheet insertion page judging means 62 has judged that the inter-sheet insertion page has come. up, the paper feeding tray changing means 63 is activated and the tray is changed from the ordinary recording paper tray to the inter-sheet tray ($c_1$).

An inter-sheet is fed from the tray and the copying process is carried out ($d_2$).

After a predetermined number of copies have been carried out, the tray changing means 63 is activated again, and the tray is changed to the ordinary recording paper tray again ($c_2$).

When the inter-sheet insertion page judging means 62 has judged that the inter-sheet insertion page has come up, in response to the result of detection, the automatic density selecting (EE) function stop and re-start means 65 is activated and the copying density of the copier is fixed to the standard density ($e_1$).

Then the copying process is carried out while there exists no document. While the EE function is stopped, the operator must refrain from feeding a document to be copied, otherwise the following page is copied on a colored paper. Since there exists no document in this copying process, the automatic density selecting (EE) function is not needed at all. Moreover, a certain period of time is needed for the EE function to be activated. In order to eliminate the loss of time caused by unnecessary operation of the automatic density selecting function, this function is stopped in the present invention during the insertion, which is the essential point of the invention and the effect is remarkable.

In response to the completion of the inter-sheet feeding (the completion of the copying process under the condition that there exists no document), the density selecting (EE) function stop and re-start means 65 is activated and the density selecting (EE) function is re-started ($e_2$).

In order to make a plurality of copies of each document, the loop process is needed (f).

As explained above, the first object of the invention can be accomplished by the copier described in the first and second examples. To explain it more concretely, the copier is provided with Intersheet Mode I or Intersheet Mode II, and further provided with: the inter-sheet feeding tray width detecting means (6) which detects the width of an inter-sheet held in a paper feeding tray; the inhibited paper width judging means 7 which judges whether the paper width detected by the inter-sheet feeding tray width detecting means 6, is an inhibited width or not; and the inhibited width displaying means 8 which displays that the width of the inter-sheet is inhibited, when the width of the inter-sheet is judged to be the inhibited width by the inhibited paper width judging means 7. Accordingly, when an operator sets a wrong size inter-sheet by mistake, the size of which is $A_3R$ or $A_2$ for example, a message is displayed that the size is inhibited, so that the operator can easily know that the paper tray in use contains an inter-sheet of an improper size. As a result, there is no fear that the operator misunderstands the copier is out of order, and that he investigates the copier to find out the cause of the problem. Consequently, the working efficiency of the operator can be improved and the copying time can be reduced, so that the effect of the present invention is remarkable.

The above-described second object of the present invention can be accomplished by the third example.

The copier of the present invention is provided with the density selecting (EE) function and stop/re-start means which stops the density selecting (EE) function in response to the action of the inter-sheet insertion page judging means, and which re-starts the density selecting (EE) function in response to the completion of the inter-sheet feeding. In Intersheet Mode, when the document page has reached the inter-sheet insertion page, the paper feeding tray is changed from the ordinary recording paper tray to the inter-sheet tray, and at the same time the function of the automatic density selecting (EE) function is temporarily stopped while an inter-sheet is conveyed, so that the operation time can be economized in an amount of about 100 ms per one document. The total time which can be economized by the invention amounts to 100 ms multiplied by the number of inter-sheets, so that the invention has a great effect on the copier.

What is claimed is:

1. An electrophotographic copying apparatus for copying a document, the copying apparatus being capable of inserting at least one inter-sheet between two successive pages of a copy of the document to distinguish preceding pages of the copy from subsequent pages, wherein an image on the document is not recorded on the inter-sheet, the copying apparatus comprising:

input means for presetting a position at which the inter-sheet is to be inserted in the copy of the document and presetting the number of inter-sheets to be inserted at that position;

control means for controlling the insertion of the inter-sheet by generating an insertion signal when sheets of the document preceding the preset position have been copied and by generating a restart signal when the preset number of inter-sheets have been conveyed to be inserted into the copy;

an automatic document feeder for feeding the document, sheet by sheet, to an exposure location, the automatic document feeder inhibiting feeding of a subsequent sheet of the document in response to the insertion signal and restarting feeding of the subsequent sheet of the document in response to the restart signal;

a tray exchanger for changing a copy sheet supply tray to be used in copying between a regular copy sheet tray and an inter-sheet tray, the tray exchanger changing to the inter-sheet tray in response to the insertion signal and changing to the regular copy sheet tray in response to the restart signal;

detector means for detecting the width of the inter-sheet contained in the inter-sheet tray;

means for inhibiting the insertion of the inter-sheet into the copy of the document by generating an inhibition signal when the detected width of the inter-sheet in the inter-sheet tray is not within a predetermined width range; and display means for displaying, in response to receiving the inhibition signal, that the width of the inter-sheet in the inter-sheet tray is outside of the predetermined width range.

2. The electrophotographic copying apparatus of claim 1, further comprising:

adjust means provided in the control means for adjusting image density of the copy, the adjust means scanning a document sheet to detect image density information of the document sheet and adjusting the image density for copying based on the image density information of the document sheet; and interrupt means provided in the control means for inhibiting the scanning operation and the adjustment operation of the adjust means during the insertion of the inter-sheet, the interrupt means inhibiting the scanning operation and the adjustment operation of the adjust means in response to the insertion signal, and allowing the scanning operation and the adjustment operation in response to the restart signal.

3. An electrophotographic copying apparatus capable of using an inter-sheet as a distinction sheet instead of a regular copy sheet, wherein an image of a corresponding page of a document is copied on the inter-sheet, the copying apparatus comprising:

input means for presetting a position at which the inter-sheet is to be inserted in a copy of the document and presetting the number of inter-sheets to be inserted at that position;

a tray exchanger for selecting a copy sheet supply tray to be used in copying from a group of regular copy sheet trays and an inter-sheet tray, the tray exchanger selecting the inter-sheet tray in response to an insertion signal and selecting a regular copy sheet tray in response to a restart signal;

control means for controlling the tray exchanger, the control means generating the insertion signal when a page preceding the preset position has been copied and generating the restart signal when the preset number of inter-sheets have been conveyed to be placed as insert-pages of the copy, both the insertion signal and the restart signal being transmitted to the tray exchanger to control the tray exchanger;

width detecting means for detecting the width of the inter-sheet contained in the inter-sheet tray;

means for inhibiting the insertion of the inter-sheet into the copy of the document by generating an inhibition signal when the detected width of the inter-sheet in the inter-sheet tray is not within a predetermined width range; and display means for displaying, in response to receiving the inhibition signal, that the width of the inter-sheet in the inter-sheet tray is outside of the predetermined width range.

* * * * *